US008238780B2

(12) United States Patent
Cavill et al.

(10) Patent No.: US 8,238,780 B2
(45) Date of Patent: Aug. 7, 2012

(54) WIPING ASSEMBLY IN AN IMAGE FORMING DEVICE

(75) Inventors: Gregory Alan Cavill, Winchester, KY (US); Benjamin Keith Newman, Lexington, KY (US); Joshua Carl Poterjoy, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 865 days.

(21) Appl. No.: 12/137,622

(22) Filed: Jun. 12, 2008

(65) Prior Publication Data

US 2009/0311001 A1 Dec. 17, 2009

(51) Int. Cl.
*G03G 15/00* (2006.01)
*G03G 21/00* (2006.01)

(52) U.S. Cl. ..... 399/98; 399/99

(58) Field of Classification Search ..... 399/34, 399/71, 98, 99
See application file for complete search history.

(56) References Cited

U.S. PATENT DOCUMENTS

| | | | | |
|---|---|---|---|---|
| 6,385,414 | B1 * | 5/2002 | Sato et al. | 399/98 |
| 7,167,661 | B2 * | 1/2007 | Hatakeyama et al. | 399/98 |
| 7,366,437 | B2 * | 4/2008 | Inui et al. | 399/98 |
| 7,460,804 | B2 * | 12/2008 | Onose et al. | 399/49 |
| 2005/0163518 | A1 * | 7/2005 | Onose et al. | 399/49 |

FOREIGN PATENT DOCUMENTS

| | | | |
|---|---|---|---|
| JP | 58065451 A | * | 4/1983 |
| JP | 58158656 A | * | 9/1983 |
| JP | 60143361 A | * | 7/1985 |
| JP | 01167856 A | * | 7/1989 |
| JP | 2005134726 A | * | 5/2005 |

* cited by examiner

*Primary Examiner* — David Gray
*Assistant Examiner* — Fred L Braun

(57) ABSTRACT

The invention provides a wiping assembly in an image forming device, to clean at least one sensor lens in the image forming device. The wiping assembly includes a bracket to move between a first position and a second position across the sensor lens. Further, the wiping assembly includes a wiper to clean the sensor lens. The wiper is located between the bracket and a sensor housing, which supports the sensor lens. The wiping assembly includes a spring to actuate the movement of the bracket between the first position and the second position. The movement of the bracket is actuated by the movement of a print media tray and/or the movement of a toner cartridge.

18 Claims, 6 Drawing Sheets

WIPING ASSEMBLY IN AN IMAGE FORMING DEVICE

BACKGROUND

1. Field of the Invention

The present invention relates generally to an image forming device, and more particularly, to a wiping mechanism used to clean one or more sensors within the image forming device.

2. Description of the Related Art

A variety of image forming devices such as printers, scanners and copiers are extensively used for image formation. Such devices produce output on different types of print media such as paper sheets, vinyl transparencies, envelopes, and the like. Prolonged use of print media produces dust, containing tiny particles of print media. Image forming devices use different types of ink and toner for image formation. Therefore, fine toner particles also constitute the dust that is present in the image forming device.

The dust settles on the internal parts of the image forming device, including the sensors. A sensor is a device that measures physical quantity and converts it into a signal to be read by an instrument or an observer. Examples of sensors used by the image forming device include, but are not limited to, toner-density sensors, paper-type sensors and toner-level sensors. Sensors are an integral part of the image forming device and are sensitive to contamination. Dust particles hinder the operation of sensors, which can cause variance in the signal produced by the sensor, thereby creating an error.

Dust on the sensors therefore needs to be removed periodically, to prevent disruption of the functioning of the sensors. In most cases, hand-held brushes are used to remove dust particles from the sensors, which are used by the image forming device. A user manually cleans the surface of the sensors by using a brush. This process tends to be tedious, time consuming and may also cause damage to the sensors.

In light of the facts given above, there is a need for a system for cleaning the sensors, which are used by the image forming device. The cleaning mechanism should be capable of removing the dust particles from the sensors with minimal user involvement. Further, the cleaning mechanism should be operable automatically.

SUMMARY OF THE INVENTION

The invention provides a wiper in an image forming device to clean at least one sensor lens. The wiper removes the dust particles from the surface of the sensor lens, thereby enabling the sensor to function properly without any hindrance. The image forming device includes a sensor housing to support one or more sensor lens, a bracket to move between a first position and a second position across the sensor lens, and a wiper located between the sensor housing and the bracket. The movement of the wiper between the first position and the second position is actuated by the movement of the bracket. In an embodiment of the invention, the movement of the bracket is, in turn, actuated by the movement of a print media tray. In another embodiment of the invention, the movement of the bracket is actuated by the movement of a toner cartridge. The wiper and the bracket are a part of a wiping assembly. The wiping assembly further includes a spring that is attached to the bracket to enable the movement of the bracket between the first position and the second position.

The wiping assembly used by the image forming device has several advantages. The wiper cleans the surface of the sensor lens by periodically removing unwanted dust particles.

Moreover, the mechanical movement of the wiper automates the cleaning process of the sensor lens with minimal user involvement.

BRIEF DESCRIPTION OF THE DRAWINGS

The above-mentioned and other features and advantages of this invention, and the manner of attaining them, will become more apparent and the invention will be better understood by reference to the following description of the embodiments of the invention, taken in conjunction with the accompanying drawings, wherein.

DETAILED DESCRIPTION

Figure 1A:
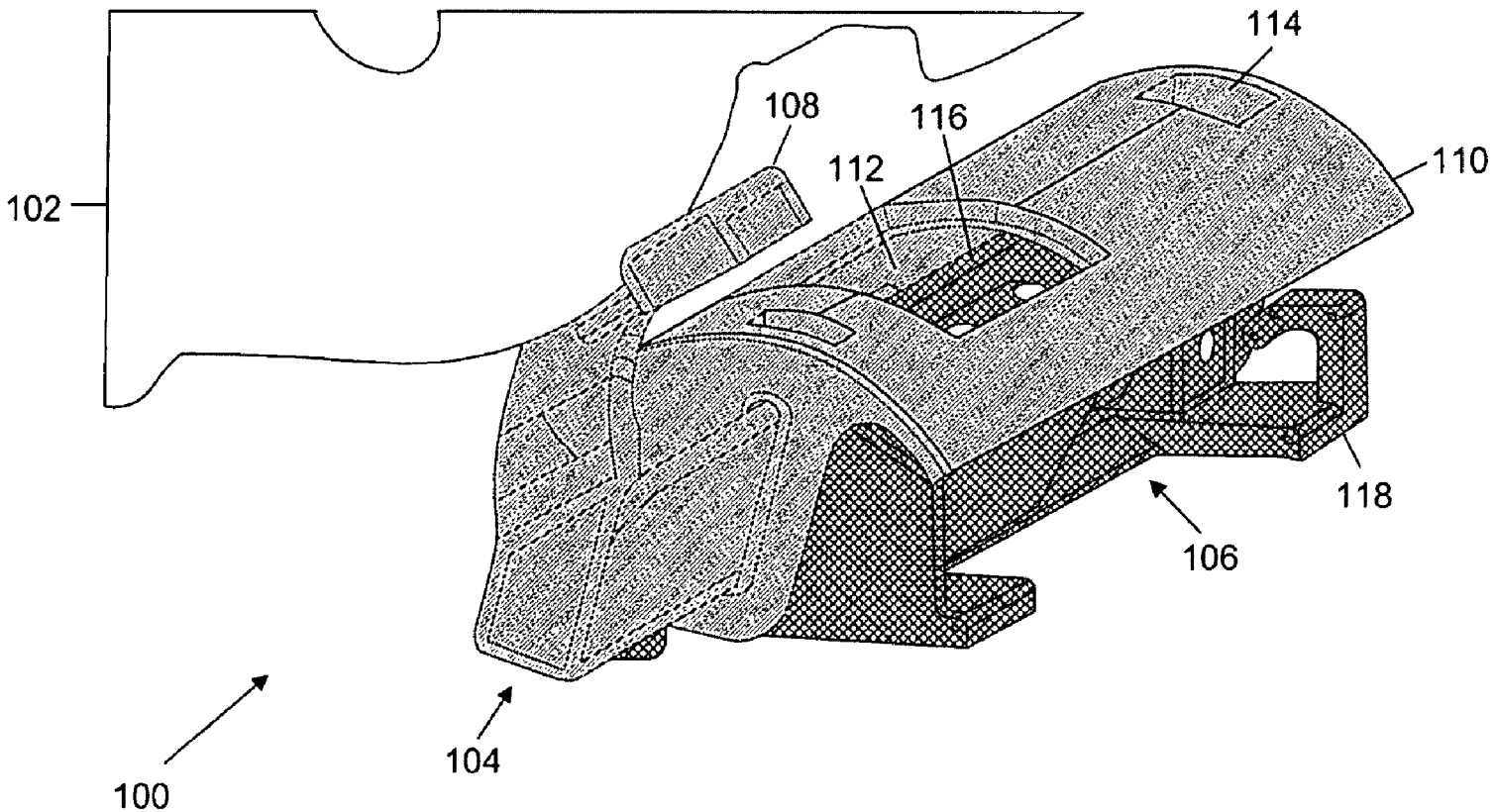
FIGS. 1(*a*) and 1(*b*) illustrate a schematic view of a toner cartridge and a wiping assembly in an image forming device, in accordance with an embodiment of the invention.

It is to be understood that the invention is not limited in its application to the details of the construction and arrangement of the components set forth in the following description or illustrated in the drawings. The invention is capable of other embodiments and of being practiced or implemented in various ways. Further, it is to be understood that the phraseology and terminology used herein is for the purpose of description and should not be regarded as limiting. The use of "including," "comprising," or "having," and variations thereof herein, is meant to encompass the items listed thereafter and the equivalents thereof, as well as the additional items. Unless limited otherwise, the terms "connected," "coupled" and "mounted," and variations thereof herein, are used broadly and encompass direct and indirect connections, couplings and mountings. In addition, the terms "connected" and "coupled" and variations thereof, are not restricted to physical or mechanical connections or couplings.

The invention provides a wiper to be used in an image forming device, to clean at least one sensor lens. The wiper is a part of a wiping assembly in the image forming device. The image forming device includes a sensor housing to support at least one sensor lens, a bracket to move across the sensor lens, and a wiper located between the sensor housing and the bracket. The wiper moves across the sensor lens with the movement of the bracket, and thereby cleans the surface of the sensor lens. Further, the wiping assembly includes a spring to actuate the movement of the bracket between a first position and a second position. In an embodiment of the invention, the movement of the bracket is actuated by the movement of a print media tray. In another embodiment of the invention, the movement of the bracket is actuated by the movement of a toner cartridge.

Figure 1B:
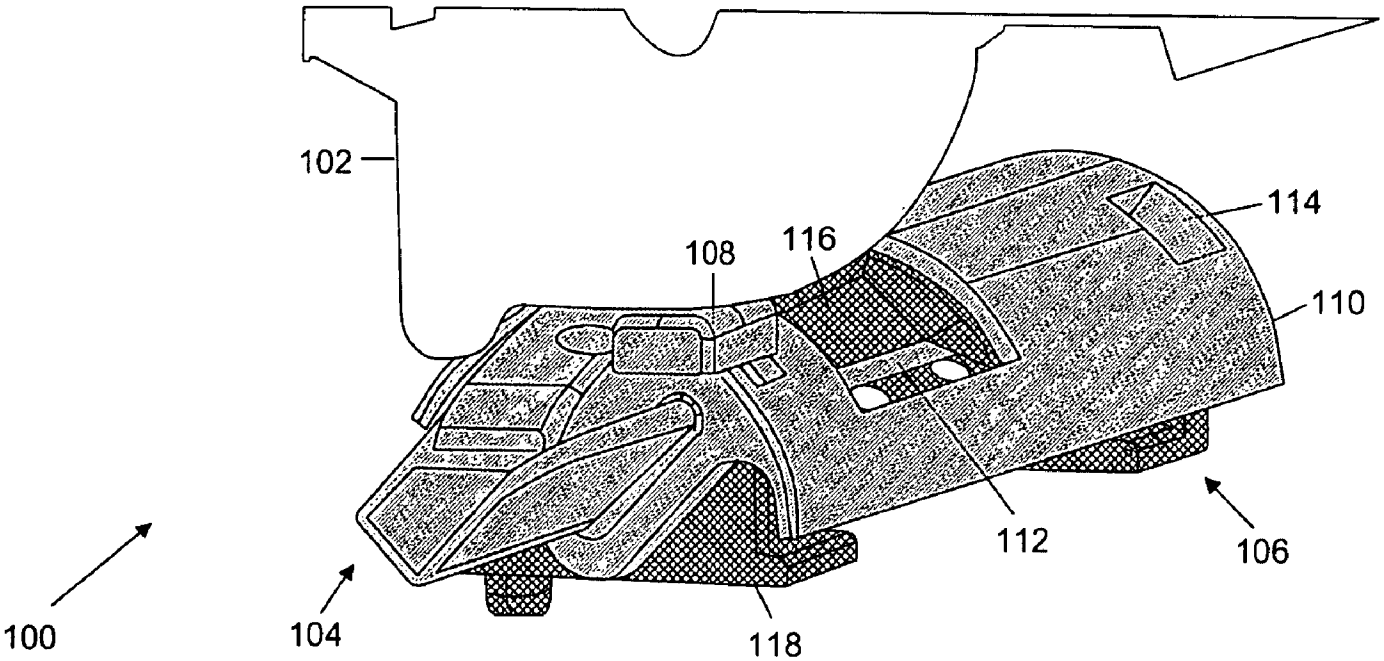

FIGS. 1(*a*) and 1(*b*) illustrate a schematic view of a toner cartridge 102 and a wiping assembly 104 in an image forming device 100, in accordance with an embodiment of the invention. Image forming device 100 includes toner cartridge 102, wiping assembly 104 and a sensor housing 106. Wiping assembly 104 includes a contact arm 108, a bracket 110, a wiper 112, and a spring 114. Sensor housing 106 includes a sensor lens 116 and a mounting bracket 118.

Wiping assembly 104 is supported by sensor housing 106. In an embodiment of the invention, wiping assembly 104 can be pivotally attached to sensor housing 106. In another embodiment of the invention, wiping assembly 104 can be attached to a guide rib on image forming device 100. In various embodiments of the invention, wiping assembly 104 can be attached to sensor housing 106 or other components of image forming device 100 using snaps, latches or fasteners.

Contact arm 108 and wiper 112 in wiping assembly 104 is attached to bracket 110. In an embodiment of the invention, wiper 112 is attached to bracket 110 at an angle. The location of wiper 112 is above sensor lens 116. In an embodiment of the invention, wiper 112 is located between bracket 110 and sensor lens 116. Sensor lens 116 is supported by mounting bracket 118. In an embodiment of the invention, sensor lens 116 is mounted on mounting bracket 118.

Wiping assembly 104 moves across sensor housing 106. In an embodiment of the invention, wiping assembly 104 rotates around sensor housing 106. The movement of wiping assembly 104 is actuated by the movement of toner cartridge 102. Wiping assembly 104 moves automatically between a first position and a second position with respect to the movement of toner cartridge 102. For example, if toner cartridge 102 is inserted in image forming device 100, wiping assembly 104 moves in a first direction, for example, a downward direction. Similarly, when toner cartridge 102 is withdrawn from image forming device 100, wiping assembly 104 moves in a second direction, for example, an upward direction.

When toner cartridge 102 is inserted in image forming device 100, a flange on the bottom of toner cartridge 102 engages contact arm 108. The engagement of the flange and contact arm 108 during the insertion of toner cartridge 102 results in the movement of bracket 110 in the first direction, for example, the downward direction. The movement of bracket 110 in the downward direction results in the movement of wiper 112 in the downward direction. Further, the movement of bracket 110 pressurizes spring 114. In an embodiment of the invention, spring 114 is compressed with the movement of bracket 110. Bracket 110 and wiper 112 move in the downward direction across sensor lens 116. In an embodiment of the invention, bracket 110 and wiper 112 rotate around sensor lens 116. The movement of wiper 112 across sensor lens 116 results in the cleaning of the surface of sensor lens 116. Further, the movement of wiper 112 in the downward direction moves wiper 112 to the first position. The placement of bracket 110 and wiper 112 in the first position is illustrated in FIG. 1(*b*).

When toner cartridge 102 is removed from image forming device 100, the flange and contact arm 108 are disengaged, which in turn releases pressure on a torsion spring attached to bracket 110. The release of pressure on the torsion spring results in an upward movement of contact arm 108. Further, the pressure on spring 114 is released with the removal of toner cartridge 102, which in turn moves bracket 110 in the second direction, for example, the upward direction. The movement of bracket 110 in the upward direction also results in the movement of wiper 112 in the upward direction.

Bracket 110 and wiper 112 move in the upward direction across sensor lens 116. The movement of wiper 112 across sensor lens 116 wipes the surface of sensor lens 116 again. The movement of wiper 112 in the upward direction moves wiper 112 to the second position. The placement of bracket 110 and wiper 112 in the second position is illustrated in FIG. 1(*a*). Therefore, whenever toner cartridge 102 is inserted or removed from image forming device 100, wiper 112 cleans the surface of sensor lens 116 automatically.

Wiper 112 can be a rectangular strip that is used to remove unwanted dust particles such as paper and toner particles from sensor lens 116. It will be evident to a person skilled in the art that wiper 112 can be of different shapes and sizes. In an embodiment of the invention, wiper 112 is 0.1 mm thick and is made of a material, for example, Polyethylene Terephthalate (PET) film, elastomers, foam and textile. In various embodiments of the invention, the thickness and the material of wiper 112 are selected such that wiper 112 exerts a force against sensor lens 116 in order to clean the surface of sensor lens 116.

Figure 2:
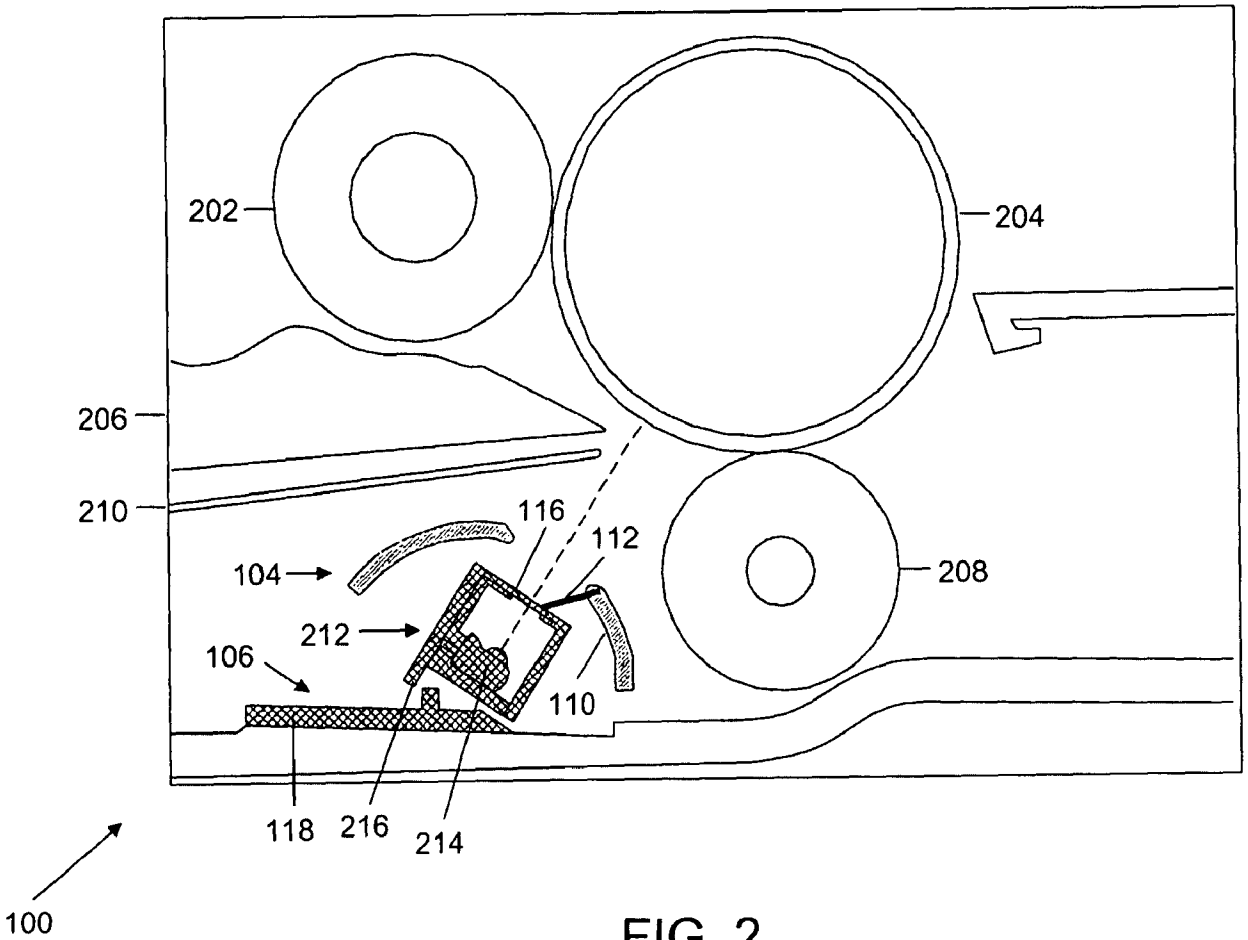
FIG. 2 illustrates a schematic internal view of the image forming device, in accordance with an embodiment of the invention.

FIG. 2 illustrates a schematic internal view of image forming device 100, in accordance with an embodiment of the invention. FIG. 2 illustrates the internal view of image forming device 100 in conjunction with wiping assembly 104 of FIG. 1(*a*) and FIG. 1(*b*). Image forming device 100 includes a developer roll 202, a photoconductor drum 204, a lower developer 206, a transfer roll 208, a paper guide 210, wiping assembly 104 and sensor housing 106. Wiping assembly 104 includes bracket 110 and wiper 112. Sensor housing 106 includes a light source 214, a Printed Circuit Board (PCB) 216, sensor lens 116 and mounting bracket 118. Light source 214 includes a Light Emitting Diode (LED) and a photodiode. Light source 214, PCB 216 and sensor lens 116 are hereinafter collectively referred to as sensor 212.

Examples of sensor 212 used by image forming device 100 include, but are not limited to, toner density sensor, toner level sensor, paper present sensor, and paper type sensor. In various embodiments of the invention, image forming device 100 includes one or more wipers 112, to clean the surface of different types of sensors used by image forming device 100.

When toner cartridge 102 is inserted in image forming device 100, the toner from toner cartridge 102 is transferred to developer roll 202. Developer roll 202 is used to uniformly transfer the toner to photoconductor drum 204. Lower developer 206 is used to prevent the toner from escaping from the edges of developer roll 202. Photoconductor drum 204 contains an electrostatically latent image, which represents the image to be printed. The toner is then transferred only to the parts of photoconductor drum 204, which contain the image to be printed. Thereafter, photoconductor drum 204 transfers the toner to print media such as paper and vinyl transparencies. The print media is passed through the nip between photoconductor drum 204 and transfer roll 208. Transfer roll 208 assists in the migration of the toner from the surface of photoconductor drum 204 to the print media. The print media is guided towards the nip between photoconductor drum 204 and transfer roll 208 by paper guide 210.

Sensor 212, supported by mounting bracket 118, detects toner density on photoconductor drum 204. Sensor 212 uses light source 214 and PCB 216 to detect toner density. The LED emits light, which passes through sensor lens 116 to reach the surface of photoconductor drum 204. In an embodiment of the invention, sensor lens 116 is made of glass or plastic. The light falling on the surface of photoconductor drum 204 is reflected back to the photodiode. The light is reflected back from the surface with toner and surface without toner of photoconductor drum 204. Sensor 212 then measures the reflected light. Sensor 212 measures the difference in the light that is reflected from the surface with toner and from the surface without toner. Extensive usage of image forming device 100 for printing purposes results in accumulation of dust particles on the surface of sensor lens 116.

Therefore, when toner cartridge 102 is inserted in image forming device 100, bracket 110 and wiper 112 move across sensor lens 116, as explained in conjunction with FIG. 1(*a*) and FIG. 1(*b*). The movement of wiper 112 across sensor lens 116 cleans the surface of sensor lens 116. Sensor lens 116 needs to be cleaned to clear the path of the light that is emitted by the LED.

Figure 3:
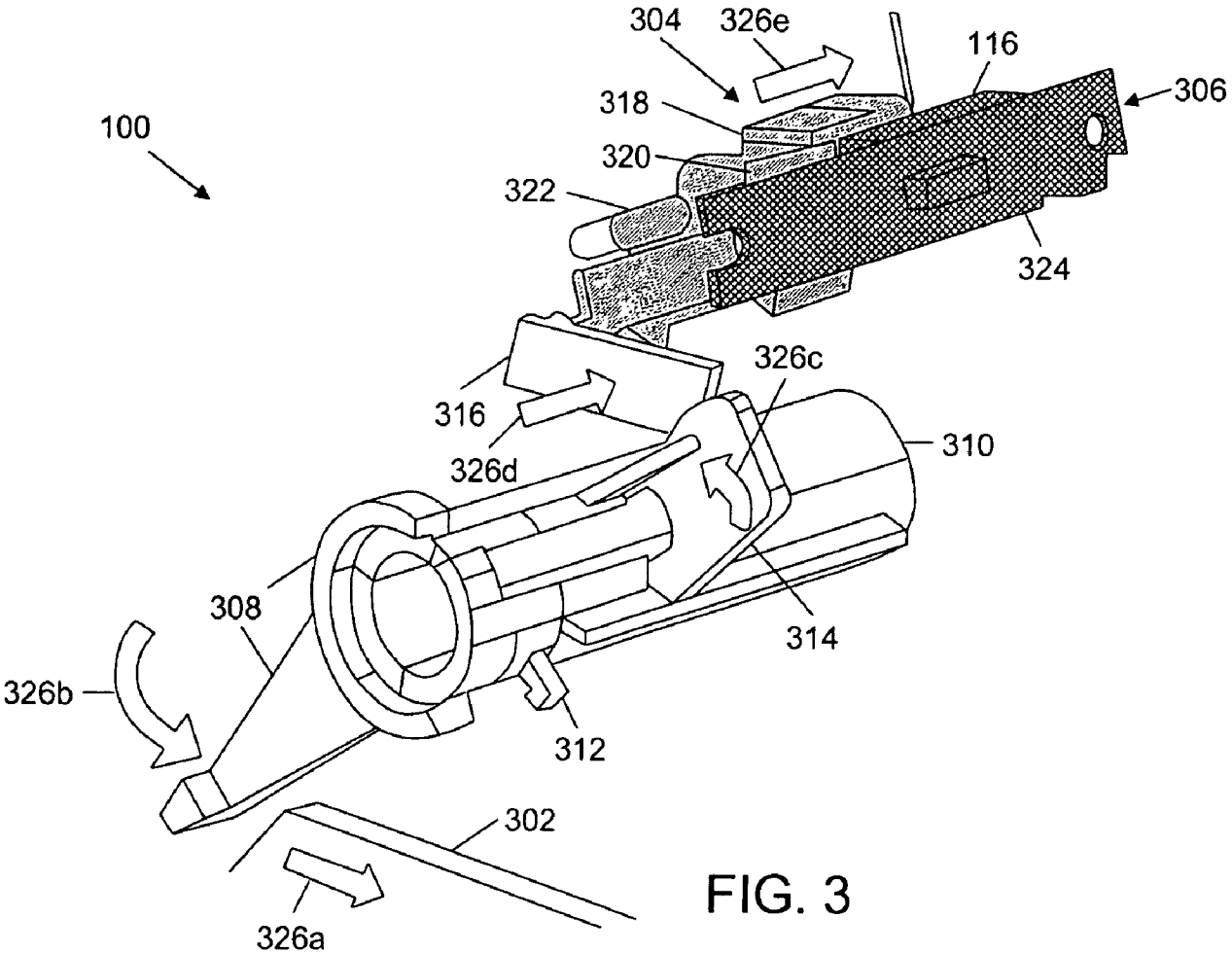
FIG. 3 illustrates a schematic view of the wiping assembly in the image forming device, in accordance with another embodiment of the invention.

FIG. 3 illustrates a schematic view of a wiping assembly 304 in image forming device 100, in accordance with another embodiment of the invention. Image forming device 100 includes a print media tray 302, wiping assembly 304, a sensor housing 306, a tray cam 308, a rotating cylinder 310, a hook 312, a first element 314 and a second element 316. Wiping assembly 304 includes a bracket 318, a wiper 320 and a spring 322. Sensor housing 306 includes sensor lens 116 and a mounting bracket 324.

Wiping assembly 304 is supported by sensor housing 306. In an embodiment of the invention, wiping assembly 304 can be attached to sensor housing 306 using snaps, latches or fasteners. Tray cam 308 is supported by rotating cylinder 310. Hook 312 is attached to rotating cylinder 310. A return spring is attached to hook 312. First element 314 is attached to rotating cylinder 310. Rotating cylinder 310, tray cam 308 and first element 314 may combine to form a coupling member for coupling print media tray 302 and bracket 318. In an embodiment of the invention, first element 314 is a protrusion that extends above the surface of rotating cylinder 310. Further, second element 316 is actuated by first element 314. In an embodiment of the invention, second element 316 is actuated by first element 314 at an angle. FIG. 3 illustrates second element 316 as having an angled surface relative to first element 314, and FIGS. 5(*a*) and 5(*b*) further illustrate the angled surface of second element 316. Furthermore, second element 316 is attached to bracket 318, which in turn is attached to wiper 320 and spring 322. Wiper 320 is attached above sensor lens 116, which is further supported by mounting bracket 324.

Wiping assembly 304 moves across sensor housing 306. In an embodiment of the invention, wiping assembly 304 slides across sensor housing 306. The movement of wiping assembly 304 is actuated by the movement of print media tray 302. Wiping assembly 304 automatically moves between a first position and a second position with respect to the movement of print media tray 302. For example, if print media tray 302 is withdrawn from image forming device 100, wiping assembly 304 moves in a first direction, for example, direction-of-travel 326*e*, as depicted in FIG. 3. Similarly, when print media tray 302 is inserted in image forming device 100, wiping assembly 304 moves in a second direction, for example, in an opposite direction of direction-of-travel 326*e*.

When print media tray 302 is withdrawn from image forming device 100, illustrated as direction-of-travel 326*a*, the pressure on the return spring is released. The release of pressure on the return spring causes the rotation of tray cam 308 and rotating cylinder 310 in an anti-clockwise direction, as illustrated by direction-of-travel 326*b*. Hook 312 rotates due to the rotation of rotating cylinder 310. Further, the rotation of rotating cylinder 310 rotates first element 314 in the anti-clockwise direction, as illustrated by direction-of-travel 326*c*. The rotation of first element 314, in turn, actuates the movement of second element 316 in a direction illustrated by direction-of-travel 326*d*. In an embodiment of the invention, second element 316 moves in a direction transverse to the direction of the movement of print media tray 302. The transverse direction of movement results in second element 316 sliding towards sensor housing 306. Thereafter, the movement of second element 316 actuates the movement of bracket 318 in the first direction, illustrated as direction-of-travel 326*e*. The movement of bracket 318 in direction-of-travel 326*e* results in the movement of wiper 320 in direction-of-travel 326*e*, i.e., bracket 318 and wiper 320 move across sensor lens 116. Further, the movement of bracket 318 exerts a pressure on spring 322 causing spring 322 to expand.

In an embodiment of the invention, bracket 318 and wiper 320 slide across sensor lens 116. The movement of wiper 320 across sensor lens 116 cleans the surface of sensor lens 116. Further, the movement of wiper 320 in direction-of-travel 326*e* moves wiper 320 to the first position.

When print media tray 302 is inserted in image forming device 100, tray cam 308 is pushed by print media tray 302, which in turn rotates tray cam 308 and rotating cylinder 310 in a clockwise direction. The clockwise rotation of rotating cylinder 310 causes the clockwise rotation of hook 312, which then pressurizes the return spring attached to hook 312. Further, the rotation of rotating cylinder 310 rotates first element 314 in the clockwise direction. The rotation of first element 314 actuates the movement of second element 316 in the opposite direction of direction-of-travel 326*d*. Direction-of-travel 326*d* is transverse to the direction of the movement of print media tray 302. In an embodiment of the invention, second element 316 slides away from sensor housing 306. Subsequently, the movement of second element 316 releases pressure on spring 322. In an embodiment of the invention, the movement of second element 316 contracts spring 322. Release in the pressure on spring 322 results in the movement of bracket 318 in the second direction, i.e., in the opposite direction of direction-of-travel 326*e*. The movement of bracket 318 results in the movement of wiper 320 in the second direction, i.e., in the opposite direction of direction-of-travel 326*e*. The movement of bracket 318 and wiper 320 in the opposite direction of direction-of-travel 326*e* again results in the movement of bracket 318 and wiper 320 across sensor lens 116. The movement of wiper 320 across sensor lens 116 cleans the surface of sensor lens 116. The movement of wiper 320 in the second direction moves wiper 320 to a second position, as illustrated in FIG. 3. Therefore, whenever print media tray 302 is inserted or removed from image forming device 100, wiper 320 cleans the surface of sensor lens 116 automatically.

It should be noted by a person skilled in the art that the directions-of-travel depicted in FIG. 3 have been presented for the purpose of illustration. It is not intended to be exhaustive or limit the invention to the precise movements disclosed, and obviously, many modifications and variations are possible in light of the teaching above.

Figure 4:
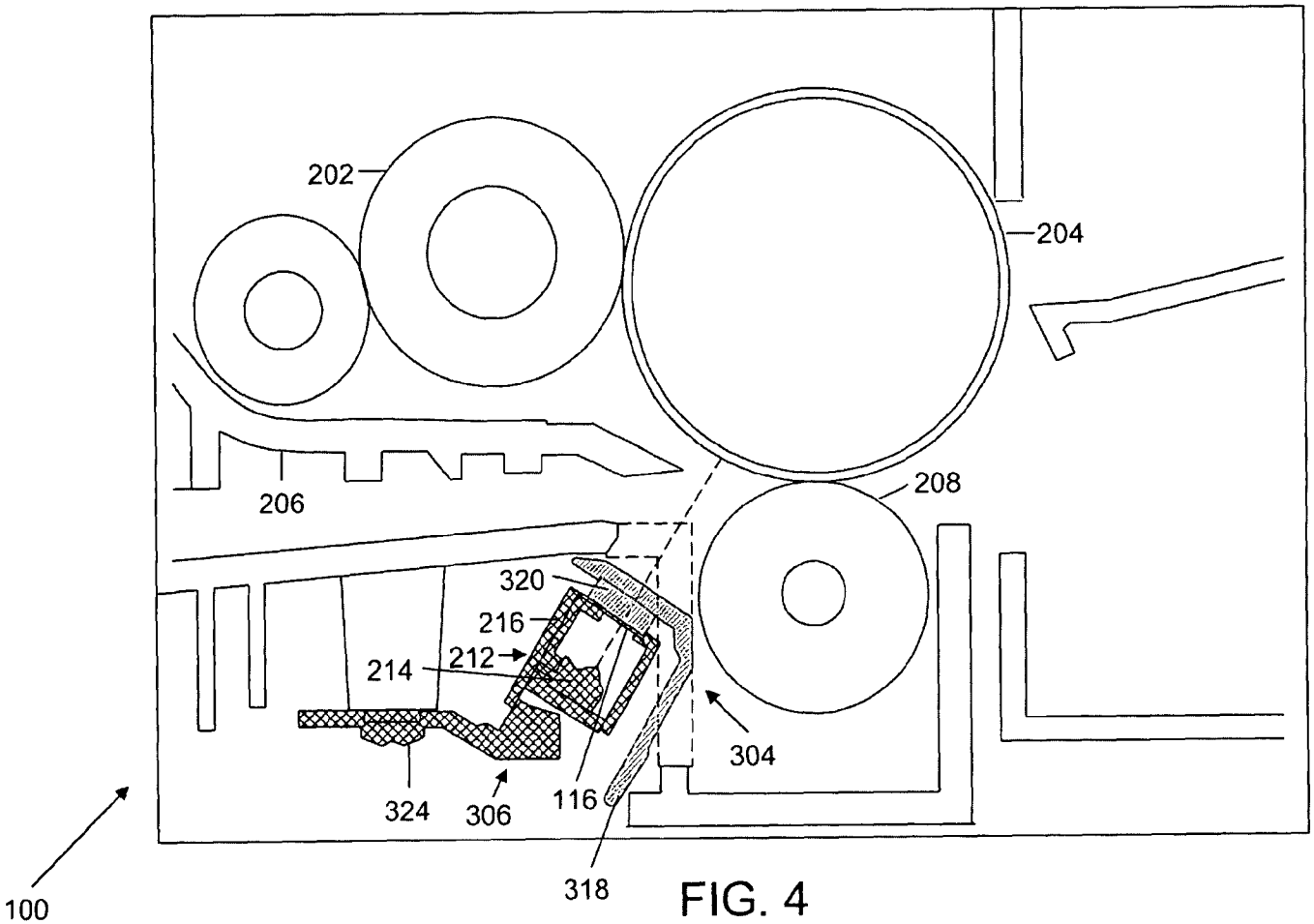
FIG. 4 illustrates a schematic internal view of the image forming device, in accordance with another embodiment of the invention.

FIG. 4 illustrates a schematic internal view of image forming device 100, in accordance with another embodiment of the invention. FIG. 4 illustrates the internal view of image forming device 100 in conjunction with wiping assembly 304 of FIG. 3. Image forming device 100 includes developer roll 202, photoconductor drum 204, lower developer 206, transfer roll 208, wiping assembly 304 and sensor housing 306. Wiping assembly 304 includes bracket 318 and wiper 320. Sensor housing 306 includes light source 214, PCB 216, sensor lens 116 and mounting bracket 324. Light source 214 includes the LED and the photodiode. Light source 214, PCB 216 and sensor lens 116 are hereinafter collectively referred to as sensor 212.

All components of image forming device 100 perform their respective functions, as explained in conjunction with FIG. 2. Wiping assembly 304 moves across sensor housing 306, as explained in conjunction with FIG. 3. The movement of wiper 320 across sensor lens 116 cleans the surface of sensor lens 116.

Figure 5A:
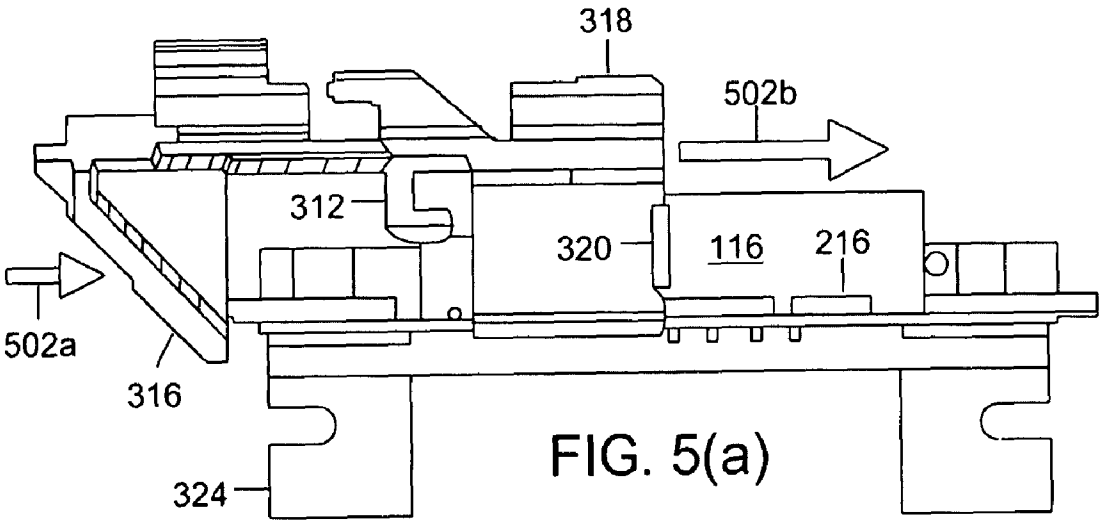
FIGS. 5(*a*) and 5(*b*) illustrate a schematic side view of the image forming device, in accordance with an embodiment of the invention.
Figure 5B:
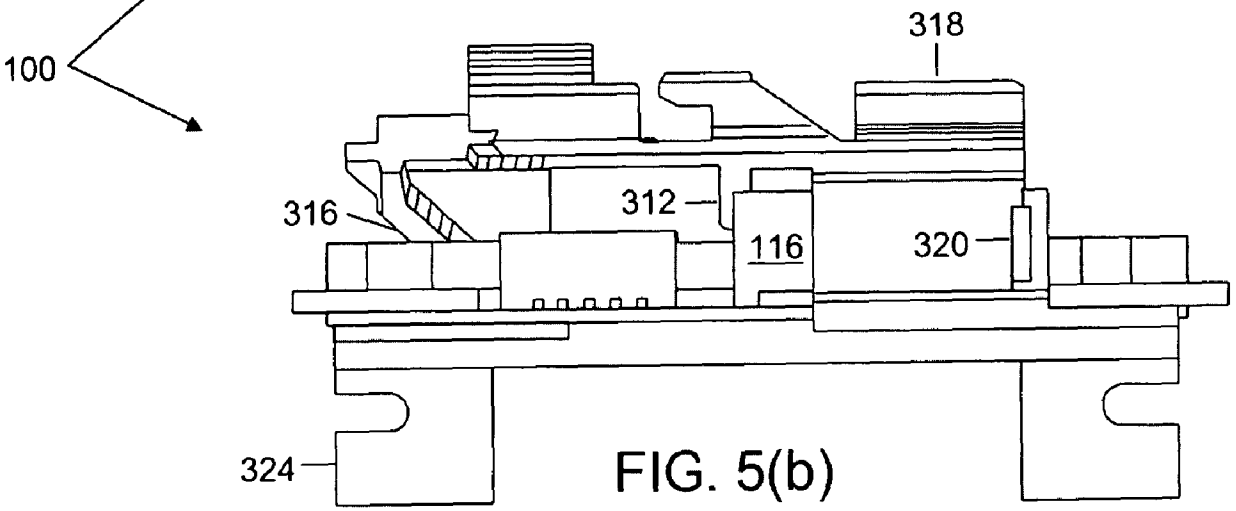

FIGS. 5(*a*) and 5(*b*) illustrate a schematic side view of image forming device 100, in accordance with another embodiment of the invention. FIGS. 5(*a*) and 5(*b*) illustrate the schematic side view of image forming device 100 in conjunction with wiping assembly 304 of FIG. 3. FIG. 5(*a*) illustrates a schematic side view of image forming device 100 when print media tray 302 is inserted in image forming device 100. FIG. 5(*b*) illustrates a schematic side view of image forming device 100 when print media tray 302 is removed from image forming device 100. Image forming device 100 includes hook 312, second element 316, bracket 318, wiper 320, mounting bracket 324, sensor lens 116 and PCB 216. All components of image forming device 100 are connected to each other, as explained in conjunction with FIG. 3.

When print media tray 302 (not shown in FIG. 5(*a*) and FIG. 5(*b*)) is withdrawn from image forming device 100, the pressure on the return spring attached to hook 312 is released. The release of pressure on the return spring causes the rotation of tray cam 308 (not shown in FIG. 5(*a*) and FIG. 5(*b*)) and rotating cylinder 310 (not shown in FIG. 5(*a*) and FIG. 5(*b*)) in an anti-clockwise direction. Hook 312 rotates due to the rotation of rotating cylinder 310. Further, the rotation of rotating cylinder 310 rotates first element 314 (not shown in FIG. 5(*a*) and FIG. 5(*b*)) in the anti-clockwise direction. The rotation of first element 314, in turn, actuates the movement of second element 316 in an opposite direction of direction-of-travel 502*a*. Direction-of-travel 502*a* is opposite to the direction-of-travel 326*d*. Thereafter, the movement of second element 316 actuates the movement of bracket 318 in the first direction, i.e., in the opposite direction of direction-of-travel 502*b*. Direction-of-travel 502*b* is opposite to the direction-of-travel 326*e*. The movement of bracket 318 results in the movement of wiper 320 in the opposite direction of direction-of-travel 502*b*, i.e., bracket 318 and wiper 320 move across sensor lens 116. Further, the movement of bracket 318 exerts a pressure on spring 322 (not shown in FIG. 5(*a*) and FIG. 5(*b*)) causing spring 322 to expand.

In an embodiment of the invention, bracket 318 and wiper 320 slide across sensor lens 116. The movement of wiper 320 across sensor lens 116 cleans the surface of sensor lens 116. Further, the movement of wiper 320 in the opposite direction of direction-of-travel 502*b* moves wiper 320 to the first position, as illustrated in FIG. 5(*b*).

When print media tray 302 is inserted in image forming device 100, tray cam 308 is pushed by print media tray 302, which in turn rotates tray cam 308 and rotating cylinder 310 in a clockwise direction. The clockwise rotation of rotating cylinder 310 causes the clockwise rotation of hook 312, which then pressurizes the return spring attached to hook 312. Further, the rotation of rotating cylinder 310 rotates first element 314 in the clockwise direction. The rotation of first element 314 actuates the movement of second element 316 in the direction-of-travel 502*a*. Subsequently, the movement of second element 316 releases pressure on spring 322. In an embodiment of the invention, the movement of second element 316 contracts spring 322. Release in the pressure on spring 322 results in the movement of bracket 318 in the second direction, i.e., in the direction-of-travel 502*b*. The movement of bracket 318 results in the movement of wiper 320 in the second direction, i.e., in the direction-of-travel 502*b*. The movement of bracket 318 and wiper 320 in the direction-of-travel 502*b* again results in the movement of bracket 318 and wiper 320 across sensor lens 116. The movement of wiper 320 across sensor lens 116 cleans the surface of sensor lens 116. The movement of wiper 320 in the second direction moves wiper 320 to a second position, as illustrated in FIG. 5(*a*). Therefore, whenever print media tray 302 is inserted or removed from image forming device 100, wiper 320 cleans the surface of sensor lens 116 automatically.

A wiper, for example, wiper 112 and wiper 320 described above have several advantages. The wiper cleans the surface of sensor lens 116 by periodically removing unwanted dust particles such as ink or toner particles, and particles of print media such as paper and envelopes. Moreover, the mechanical movement of the wiper automates the cleaning process of sensor lens 116 with minimal user involvement.

The foregoing description of several methods and an embodiment of the invention have been presented for the purpose of illustration. It is not intended to be exhaustive or limit the invention to the precise steps and/or forms disclosed, and obviously, many modifications and variations are possible in light of the teaching above. It is intended that the scope of the invention be defined by the claims appended hereto.

What is claimed is:

1. An image forming device comprising;

a sensor housing for supporting at least one sensor lens;

a bracket moving across the at least one sensor lens;

a wiper supported by the bracket, wherein the wiper moves between a first position and a second position for cleaning the at least one sensor lens, the movement of the wiper being actuated by the movement of the bracket;

an actuating device substantially linearly movable within the image forming device; and a coupling member coupled between the actuating device and the bracket, wherein the bracket includes a contact element which contacts the coupling member so that substantially linear movement of the actuating device causes substantially linear movement of the bracket and wiper in a direction that is transverse to a direction of movement of the actuating device.

2. The image forming device according to claim 1, wherein the wiper is located between the sensor housing and the bracket.

3. The image forming device according to claim 1, wherein the actuating device is a print media tray.

4. The image forming device according to claim 3, wherein the wiper moves towards the first position when the print media tray is removed from the image forming device.

5. The image forming device according to claim 3, wherein the wiper moves towards the second position when the print media tray is inserted in the image forming device.

6. The image forming device according to claim 3, wherein the coupling member comprises a tray cam, wherein the tray cam moves with the movement of the print media tray, the movement of the tray cam actuating the movement of the bracket.

7. The image forming device according to claim 1, wherein the bracket slides across the at least one sensor lens.

8. The image forming device according to claim 1, wherein the at least one sensor lens is a toner density sensor lens.

9. The image forming device of claim 1, wherein the coupling member comprises a rotational member which rotates responsive to the substantially linear movement of the actuating device, and a second contact element rotating with rotation of the rotational member and contacting the contact element of the bracket so as to induce substantially linear movement thereof.

10. The image forming device of claim 9, wherein the contact element of the bracket includes an angled surface which engages with a surface of the second contact element of the coupling member such that rotational movement of the second contact element causes substantially linear movement of the bracket.

11. An assembly suitable for use in an image forming device, the image forming device comprising a sensor housing for supporting at least one sensor lens, wherein the assembly is used for cleaning the at least one sensor lens, the assembly comprising:

a bracket for moving between a first position and a second position across the at least one sensor lens, the bracket comprising a spring for enabling the movement of the bracket between the first position and the second position;

a wiper supported by the bracket, the wiper being located between the sensor housing and the bracket, wherein the wiper moves between the first position and the second position for cleaning the at least one sensor lens, the movement of the wiper being actuated by the movement of the bracket; and a coupling member coupled to the bracket, the coupling member rotating in response to movement of an actuating member, wherein the bracket includes a contacting element for contacting the coupling member and moving the bracket in a first substantially linear direction in response to rotation of the coupling member.

12. The assembly according to claim 11, wherein the bracket moves in a second substantially linear direction opposite the first direction when actuated by one of contraction and expansion of the spring.

13. The assembly according to claim 12, wherein the coupling member comprises a cylindrical member and a tray cam extending therefrom, wherein the spring is contracted and expanded due to rotation of the tray cam in the image forming device.

14. The assembly according to claim 13, wherein the rotation of the tray cam is actuated by movement of a print media tray in the image forming device.

15. The assembly according to claim 12, wherein the coupling member comprises a cylindrical member and a contact arm extending therefrom, the contact arm contacting the contacting element of the bracket such that rotation of the cylindrical member causes rotation of the contact arm and substantially linear movement of the contacting element, and the spring is contracted and expanded due to movement of the contact arm in the image forming device.

16. The assembly according to claim 11, wherein the wiper is made of polyethylene terephthalate film.

17. The assembly of claim 11, wherein the coupling member comprises a substantially cylindrical member and a contact arm extending therefrom, the contact arm contacting the contacting element of the bracket such that rotation of the cylindrical member causes rotation of the contact arm and substantially linear movement of the contacting element and bracket.

18. The assembly of claim 17, wherein the contacting element of the bracket includes an angled surface relative to the contact arm which engages with a surface of the contact arm such that rotational movement of the contact arm causes substantially linear movement of the bracket.

* * * * *